US008262215B2

(12) United States Patent
Izuo

(10) Patent No.: US 8,262,215 B2
(45) Date of Patent: Sep. 11, 2012

(54) DOT OMISSION INSPECTION METHOD USED IN PRINTING APPARATUS AND THE PRINTING APPARATUS

(75) Inventor: Seiji Izuo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 114 days.

(21) Appl. No.: 12/962,281

(22) Filed: Dec. 7, 2010

(65) Prior Publication Data

US 2011/0141177 A1 Jun. 16, 2011

(30) Foreign Application Priority Data

Dec. 11, 2009 (JP) ..... 2009-281938

(51) Int. Cl.
*B41J 2/01* (2006.01)

(52) U.S. Cl. ..... 347/102; 347/16; 347/101

(58) Field of Classification Search ..... None
See application file for complete search history.

(56) References Cited

U.S. PATENT DOCUMENTS 7,354,127 B2 * 4/2008 Endo ..... 347/19
2007/0040885 A1 * 2/2007 Kusunoki ..... 347/102

FOREIGN PATENT DOCUMENTS

JP 2005-035042 2/2005

* cited by examiner

*Primary Examiner* — Uyen Chau N Le
*Assistant Examiner* — Chad Smith

(57) ABSTRACT

Provided is a dot omission inspection method used in a printing apparatus for forming an image constituted by dots of first and second photo-durable inks. In the dot omission inspection method, an arbitrary image is formed by performing liquid droplet discharge of causing a liquid droplet of the first or second ink to be landed on a medium, performing provisional curing of irradiating the landed liquid droplet using light from a first light source so as to be provisionally cured, and performing main curing of irradiating the provisionally cured liquid droplet using light from a second light source to fix the liquid droplet on the medium. An inspection image is formed without performing the provisional curing on the liquid droplet of the first ink landed on the medium by performing the liquid droplet discharge, and by causing the liquid droplet of the second ink to be landed by performing the liquid droplet discharge at the same position as the liquid droplet of the first ink which is not provisionally cured so as to mix the first ink and the second ink with each other.

8 Claims, 10 Drawing Sheets

DOT OMISSION INSPECTION METHOD USED IN PRINTING APPARATUS AND THE PRINTING APPARATUS

CROSS REFERENCE TO RELATED APPLICATION

Japanese Patent Application No. 2009-281938 is hereby incorporated by reference in its entirety.

BACKGROUND

1. Technical Field

The present invention relates to a method of inspecting for the omission of a dot to be formed by ink landing on a medium in a printing apparatus such as an ink jet printer for intermittently discharging the ink onto the medium to cause the ink to land at target positions on the medium, and a printing apparatus for forming dots on a medium using the inspection method.

2. Related Art

As a printing apparatus, an ink jet printer for performing printing by intermittently discharging ink onto various types of media such as paper, fabric, or film is known. The ink jet printer forms an image by depositing fine dots formed of ink droplets on the medium. With regard to a configuration or printing operation of the ink jet printer, for example, the medium is moved in a particular transport direction and simultaneously, an ink discharge head in which nozzles for discharging ink over the width of the medium are fixed in lines or a zigzag form discharge ink while moving the medium in the transport direction, thereby forming an image. Accordingly, ink droplets discharged from the nozzles land at target positions on the surface of the medium. In addition, an ink jet printer of a so-called line printer type for forming landed ink droplets as dots to form an image, or a so-called serial printer for reciprocating a head in which nozzles are disposed in a range narrower than the width of a medium in a scanning direction intersecting the transport direction to land ink droplets discharged from the nozzles at target positions on the surface of the medium, are known.

Moreover, ink is charged in an ink tank, is led by a pump from the ink tank into a space called a reservoir inside the head, and then is guided from the reservoir to a pressure chamber connected to the nozzle. In addition, the pressure chamber is expanded or contracted to discharge the ink from the nozzle.

However, in the ink jet printer, there may be a case where the nozzles clog due to ink sticking and thus ink is not suitably discharged. In addition, there may be a case where the mechanism for discharging ink malfunctions and thus ink is not suitably discharged. In these cases, liquid droplets of the ink are not landed on the medium and a so-called "dot omission error" occurs. Therefore, in an ink jet printer, the existence of such a dot omission error needs to be inspected for. In this inspection, for example, dots are formed into a predetermined pattern on a medium and the dots are optically analyzed. The optical inspection may be performed on the predetermined pattern (test pattern) of the dots using an optical sensor or an image recognition technique, or may be performed by checking the test pattern with the naked eye. In either case, ink is actually discharged on the medium for the inspection.

Hitherto, for the ink jet printers, various methods of inspecting whether or not there is a dot omission error by actually performing printing on a recording sheet have been proposed. For example, in a method disclosed in JP-A-2005-35042, an image sensor is provided in the printer, and the printing state is detected using the image sensor to check for the existence of a dot omission. When the dot omission exists, a position of the dot omission is stored to be compensated for by another nozzle or the like during printing. In either case, there is a method of printing a predetermined pattern or the like as an inspection image and optically inspecting for a dot omission the inspection image using an optical instrument or with the naked eye.

In a general ink jet printer, to perform multi-color printing, ink is discharged from nozzles corresponding to respective colors to form a color image. In addition, as such color ink jet printers, there are various types depending on characteristics or kinds of ink used, methods of fixing ink droplets on a medium, and the like. It is determined that in certain types of printers, there are several cases where it is difficult to optically inspect for a dot omission, such as in a case where the ink color is similar to the color of the medium.

SUMMARY

According to an aspect of the invention, there is provided a dot omission inspection method of inspecting for the existence of an omission of a dot, used in a printing apparatus which discharges a first photo-curable ink and a second photo-curable ink from respective nozzles to be landed on a medium as liquid droplets and irradiates the landed liquid droplets with light to be cured so as to form an image constituted by fine dots on the medium, wherein the printing apparatus selectively performs, as a process of forming the image, a normal print process of forming an arbitrary image and an inspection print process of forming an inspection image as a detection object for a dot omission, wherein the normal print process includes: performing liquid droplet discharge of causing a liquid droplet of the first or second photo-curable ink to be landed on the medium; performing provisional curing of irradiating the liquid droplet landed on the medium using light from a first light source to provisionally cure the liquid droplet so as to suppress flowing of the liquid droplet; and performing main curing of irradiating the provisionally cured liquid droplet using light from a second light source to cure the provisionally cured liquid droplet so as to be fixed on the medium, and wherein, in the inspection print process, the provisional curing is not performed on the liquid droplet of the first ink landed on the medium by the liquid droplet discharge, and the liquid droplet of the second ink is landed by the liquid droplet discharge at the same position as the liquid droplet of the first ink which is not provisionally cured so as to mix the first ink and the second ink with each other.

Further features of the invention will become apparent from the following description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Ink Colors

Figure 1:
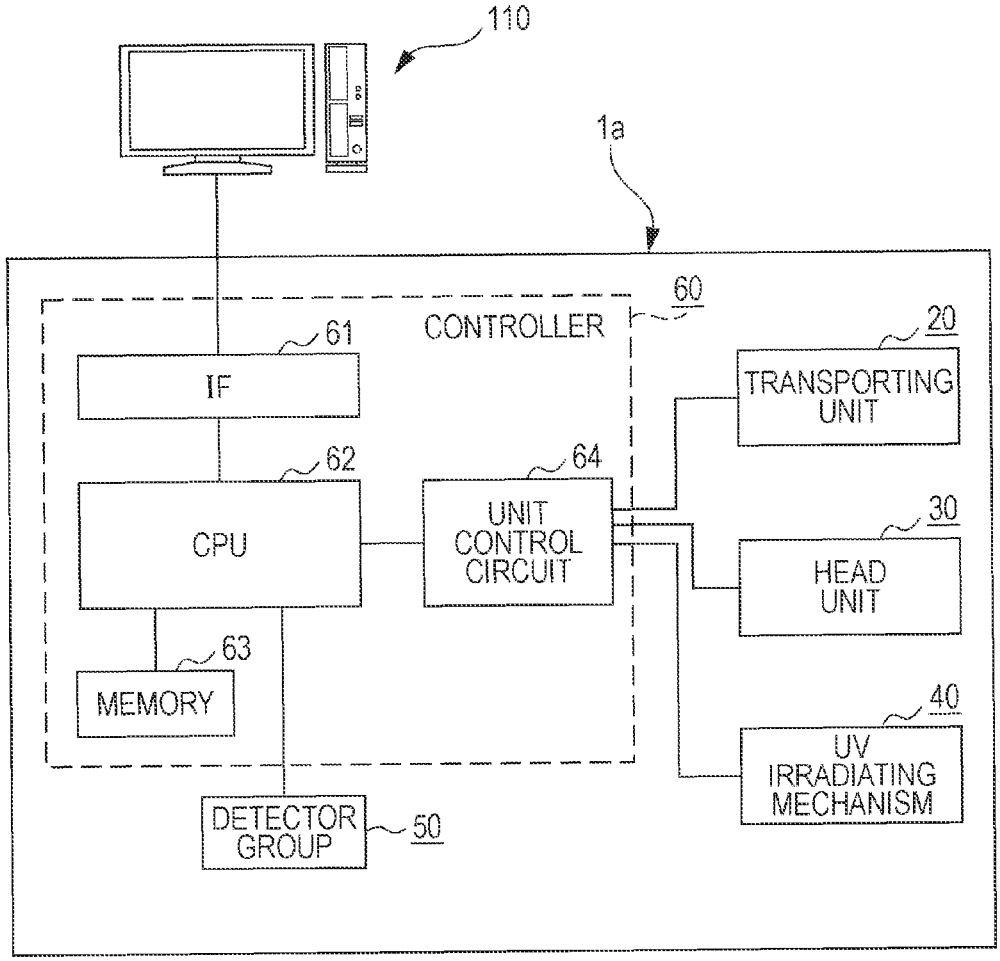
FIG. 1 is a block diagram illustrating the entire configuration of a printer according to a first embodiment of the invention.

As described above, like an ink jet printer, in a printing apparatus having a type of discharging ink onto a medium to form an image, when an optical dot omission inspection is performed, there may be a case where the contrast between the ink and a color of the medium is very small and thus the inspection cannot be easily performed.

For example, in order to enhance image quality or prevent color fading or discoloration of a printed image, a transparent ink called a clear ink which is discharged as a coating onto an image formed with color ink may be used. Although liquid droplets of the clear ink are landed on the medium, it naturally follows that it is difficult to optically detect only the liquid droplets of the clear ink on the basis that the color of a medium or the color of dot of the color ink is transmitted through the clear ink that is coating it.

In addition, there is "white ink" having a white color. The white ink is used, when printing is performed on a transparent medium such as a clear sheet, to prevent colors of a background where the printing is originally not performed or a color image from being affected by colors at the back of the medium. Certainly, when a clear sheet is used to perform the dot omission inspection, the contrast to the background color is increased, and the optical detection may be performed more easily. However, a clear sheet is more expensive than a paper medium and thus causes an increase in inspection costs. It is more preferable that even when white ink is used, the inspection be performed using a cheap medium such as paper. There may be a possibility that the detection of colors of ink other than white cannot be easily performed depending on the color of the background.

Of course, for industrial applications, there may be cases where ink of a color similar to that of a medium is used, such as in a case where ink with a chromaticity in a predetermined range with respect to a predetermined chromaticity of a medium is used on a medium with that chromaticity. Even in this case, the optical dot omission inspection cannot be easily performed.

Embodiments And Examples Of The Invention

The fact that it is difficult to optically detect a dot omission due to a combination of the color of the medium and the color of the ink or the like is described above. Here, for example, it is thought that, when ink of a different color is mixed, that is, when ink of a different color is landed at the same position, the two colors are mixed with each other, and ink droplets of the color which cannot be easily optically detected become ink droplets that can be easily detected. However, there is a type of printing apparatus in which a photo-curable ink that is cured by ultraviolet rays or visible light is used. In this type of printing apparatus, ink landed on a medium is irradiated with light to cure a liquid ink droplet to be fixed on the medium. In addition, as the printing apparatus using the photo-curable ink, there is a type of printing apparatus in which the liquid droplet of the ink immediately after landing is irradiated with light having a low energy compared to light irradiation for fixing in order to prevent the liquid droplet from flowing, so as to cure the surface of the liquid droplet of the ink, that is, a so-called "provisional curing" is performed. As described above, in the printer having a function of the provisional curing, as a liquid droplet of ink of a certain color is landed on a medium, the liquid droplet is provisionally cured. Therefore, even though a liquid droplet of ink of a different color is landed thereon, the inks are not mixed with each other, a liquid droplet of ink with a color similar to that of the medium cannot be optically detected, and whether or not the liquid droplet of this ink is actually landed cannot be determined.

Therefore, according to an embodiment of the invention, a printing apparatus having the provisional curing function described above is provided, and a method of reliably performing the optical dot omission inspection in the printing apparatus is an example of the invention. In addition, the example of the invention has the following features as well as the main features of the invention described above.

In the inspection print process, provisional curing is performed on the liquid droplet of the first ink and the liquid droplet of the second ink which are landed at the same position and are in a mixed state.

One of the first and second inks may be a color ink and the other may be a transparent ink. Or, one of the first and second inks may be a color ink and the other may be a white ink. Otherwise, one of the first and second inks may be an ink of a color different from the color of the medium, and the other may be an ink of a color similar to the color of the medium.

One of the first and second inks has a plurality of kinds with different colors, and in the inspection print process, a liquid droplet of the one ink of a plurality of different colors and a liquid droplet of the other ink are landed at the same position on the medium. Or, one of the first and second inks has a plurality of kinds with different colors, and in the inspection print process, a liquid droplet formed by mixing the liquid droplet of the other ink with an ink of a certain color of the one ink, and a liquid droplet formed by mixing the liquid droplet of the other ink with an ink of a different color of the one ink are individually formed.

In addition, the printing apparatus for forming an image by causing a liquid droplet to be landed on a medium according to the embodiment of the invention, includes: a plurality of nozzles for discharging a first ink and a second ink which are cured when irradiated with light as liquid droplets; a first light irradiating unit; a second light irradiating unit; and a control unit, wherein the first light irradiating unit irradiates the liquid droplets landed on the medium with light to provisionally cure the corresponding liquid droplets to prevent the liquid droplets from flowing, wherein the second light irradiating unit irradiates the liquid droplets landed on the medium with light to cure the corresponding liquid droplets so as to be fixed on the medium, wherein the control unit selectively performs a normal print process of forming an arbitrary image and an inspection print process of forming an inspection image as a detection object for a dot omission, wherein the normal print process includes: performing liquid droplet discharge of causing a liquid droplet of first or second photo-curable ink to be landed on the medium; performing a provisional curing of irradiating the liquid droplet landed on the medium using light from a first light source to provisionally cure the liquid droplet so as to suppress flowing of the liquid droplet; and performing main curing of irradiating the provisionally cured liquid droplet using light from a second light source to cure the provisionally cured liquid droplet so as to be fixed on the medium, and wherein, in the inspection print process, the provisional curing is not performed on the liquid droplet of the first ink landed on the medium by the liquid droplet discharge, and the liquid droplet of the second ink is landed by the liquid droplet discharge at the same position as the liquid droplet of the first ink which is not provisionally cured so as to mix the first ink and the second ink with each other.

First Embodiment

Figure 2A:
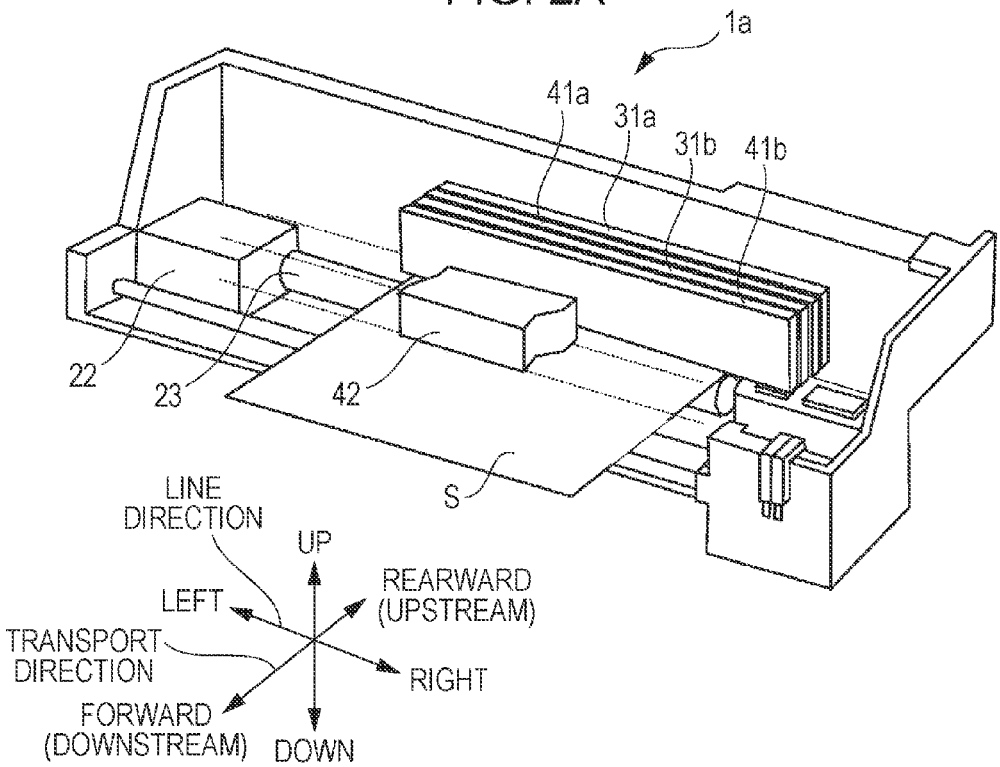
FIG. 2A is a partially cutaway perspective view of the entire configuration of the printer according to the first embodiment.
Figure 2B:
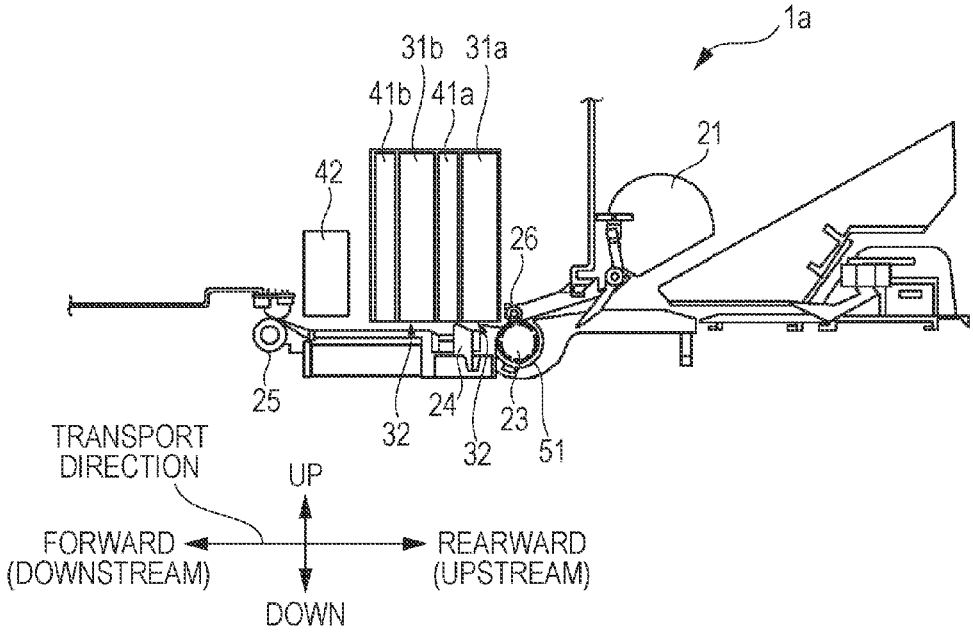
FIG. 2B is a transverse cross-sectional view of the entire configuration of the printer.

As a first embodiment for implementing a dot omission inspection method which is an example of the invention, an ink jet printer (hereinafter, referred to as a printer) which uses ink (UV ink) that is cured by ultraviolet rays (UV) is exemplified. FIG. 1 is a block diagram of the entire configuration of a printer 1*a*. In FIGS. 2A and 2B, a schematic structure of the printer 1*a* is illustrated. FIG. 2A is a cutaway perspective view of the printer 1*a*, and FIG. 2B is a transverse cross-sectional view of the printer 1*a*. The printer 1*a* illustrated is a line printer in which a head extends in a width direction (hereinafter, referred to as a line direction) of a medium and mainly includes a transporting unit 20, a head unit 30, a detector group 50, a controller 60, and a LTV irradiating mechanism 40.

The controller 60 is a control unit for controlling the printer, and includes a CPU 62 which is a processing unit, a memory 63 which is configured as a memory element such as a RAM or an EEPROM and in which a storage area for programs executed by the CPU 62 and a work area for the programs are ensured, a unit control unit 64 for driving the units 20, 30, and 40, an interface unit (IF) 61 for receiving and transmitting data between the printer 1*a* and a computer 110 which is an external apparatus, and the like.

The detector group 50 includes various sensors for detecting various statuses in the printer 1*a*, and each sensor included in the detector group 50 outputs the detection result (detection data) to the controller 60. Moreover, in the detector group 50, for example, a rotary encoder 51 for detecting the amount of rotation of a transporting roller 23, and the like are included.

The transporting unit 20 transports a medium S, such as paper, in a predetermined direction (hereinafter, referred to as a transport direction). The transporting unit 20 includes a feeding roller 21, a transporting motor 22, the transporting roller 23, a platen 24, and a discharging roller 25 as main components. The feeding roller 21 is a roller for feeding the medium S inserted into an insertion port for a medium S into the printer 1*a*. In addition, the above-mentioned transporting roller 23 is a roller for pinching the medium S with a driven roller 26 and transporting the medium S fed by the feeding roller 21 to an area where printing can be performed and is driven by the transporting motor 22. The controller 60 detects the amount of movement of the medium S on the basis of the amount of rotation of the transporting roller 23.

The platen 24 supports the medium S during printing. The discharging roller 25 is a roller which is provided on the downstream side of the transport direction with respect to the area where printing can be performed and pinches the medium S with the driven roller 27 to discharge the medium S to the outside of the printer 1*a*. The discharging roller 25 rotates in synchronization with the transporting roller 23. Moreover, the transporting roller 23 and the discharging roller 25 are designed so that their circumferences are each 1 inch and thus the transport amount per rotation is 1 inch.

The head unit 30 has a configuration for discharging ink toward the medium and includes, as well as heads 31*a* and 31*b* having nozzles, an ink tank, a pump for supplying ink to the heads from the ink tank, and the like. In this embodiment, ink of a plurality of different colors for performing multi-color printing and clear ink for coating (overcoat) a liquid droplet of color ink landed on the medium S are charged in the individual ink tanks.

In this embodiment, the UV irradiating mechanism 40 includes provisional curing irradiating units 41*a* and 41*b* for performing provisional curing and a main curing irradiating unit 42 for irradiating UV to finally fix the LTV ink onto the medium S, and simultaneously, as illustrated in FIG. 2B, has a pair of the heads 31*a* and 31*b* and a pair of the provisional curing irradiating units 41*a* and 41*b* so that the heads 31*a* and 31*b* and the provisional curing irradiating units 41*a* and 41*b* are alternately disposed along the transport direction of the medium S.

Basic Operations of Printer

The CPU 62 in the controller 60 processes print data received from the computer 110 via the IF 61, detection data received from the detector group 50, or the like by executing the programs stored in the memory 63 and controls the units 20, 30, and 40 through the unit control circuit 64 on the basis of the processing results, thereby forming a printed image on the medium S.

The printer 1*a* forms the printed image with liquid droplets of color ink and coats the ink droplets of the color ink with ink droplets of the clear ink, thereby forming an image with excellent light resistance and weather resistance or a glossy image with high quality on the medium S. The head unit 30 has a configuration for discharging the ink droplets toward the medium S. A lower surface 32 of the head unit 30 is provided with a plurality of nozzles which are opened.

Figure 3:
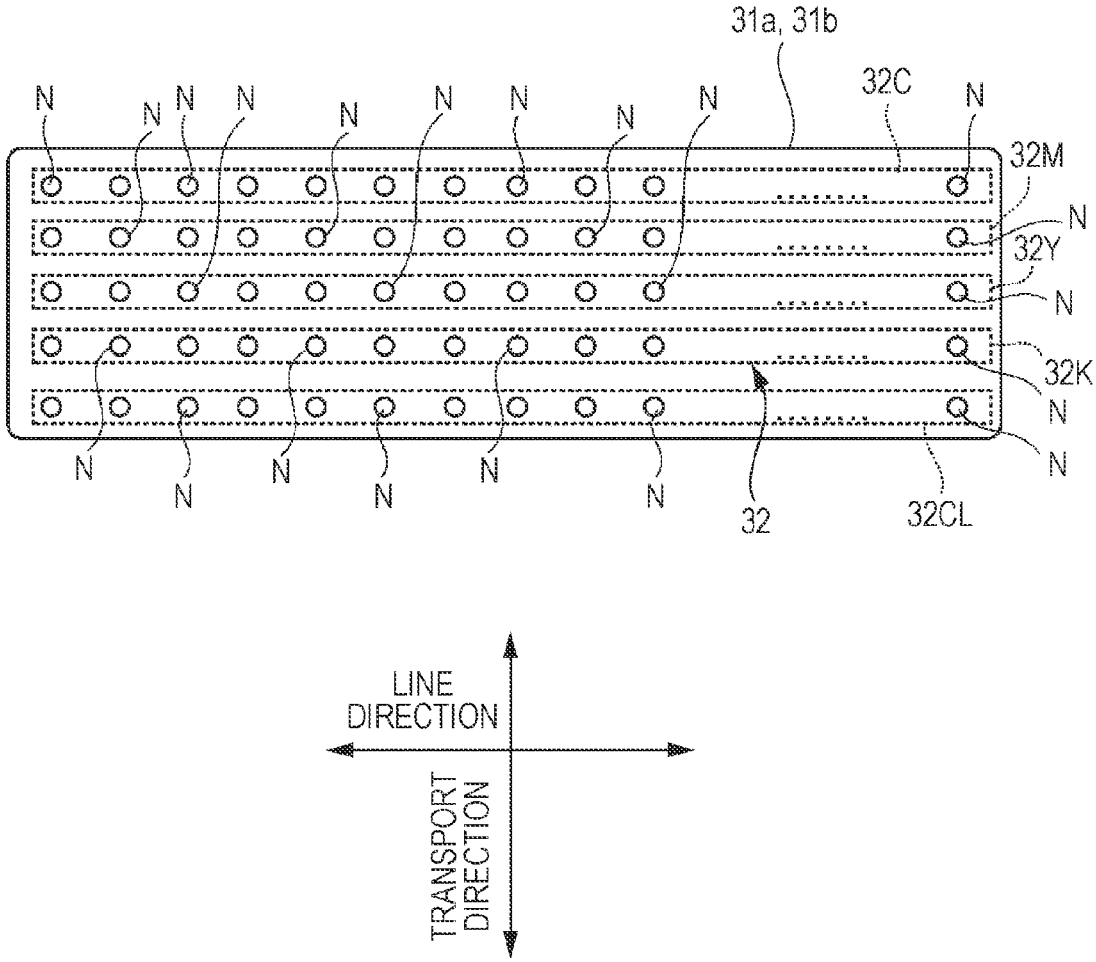
FIG. 3 is an explanatory view illustrating an array of nozzles included in the printer according to the first embodiment.

FIG. 3 illustrates an array of the nozzles N. In the lower surface 32 of the heads 31*a* and 31*b*, the plurality of the nozzles N are lined and opened at predetermined intervals in the line direction to form nozzle rows 33K, 33C, 33M, 33Y, and 33CL. The nozzle rows 33K, 33C, 33M, 33Y, and 33CL are lined at predetermined intervals along the transport direction, and the nozzle rows 33K, 33C, 33M, 33Y, and 33CL respectively correspond to inks with different colors. In this example, the black ink nozzle row 33K, the cyan ink nozzle row 33C, the magenta ink nozzle row 33M, the yellow ink nozzle row 33Y, and the clear ink nozzle row 33CL are formed.

Each nozzle N is provided with an ink chamber (not shown) and a piezo element. An ink droplet is discharged from the nozzle N as the ink chamber is expanded and contracted by driving the piezo element. In addition, as the heads 31*a* and 31*b* having the above-described configuration intermittently discharge ink droplets during transporting of the medium S, dots formed of the ink droplets on the medium S are two-dimensionally disposed on the medium S, thereby forming an image.

UV Irradiating Mechanism

In this embodiment, by irradiating the liquid droplet of the LTV ink landed on the medium S with UV, the liquid droplet (UV ink droplet) is cured as a dot for constituting an image. The LTV irradiating mechanism 40 includes a UV light source, a drive circuit for turning the light source on and off, and the like. As described above, the printer 1*a* includes the provisional curing irradiating units 41*a* and 41*b* for irradiating the UV ink droplets landed on the medium S with LTV for performing the provisional curing and the main curing irradiating unit 42 for performing UV irradiation to fully cure the UV ink droplets. In addition, an ultraviolet LED or the like may be used as the light source for the provisional curing irradiating units 41*a* and 41*b*, and a metal halide lamp or the like may be used as the light source for the main curing irradiating unit 42.

Here, assuming that the line direction is a left and right direction and the direction in which the medium S is discharged in the transport direction is defined as forward or downstream, as illustrated in FIGS. 2A and 2B, when the left and the right of the line direction are defined as viewed from the front of the printer 1*a*, the two heads 31*a* and 31*b* and the two provisional curing irradiating units 41*a* and 41*b* are alternately disposed from the upstream side toward the downstream side so that the first head (upstream side head) 31*a* is disposed on the most upstream side and the first provisional curing irradiating unit (first provisional curing irradiating unit) 41*a*, the downstream side head 31*b*, and the second provisional curing irradiating unit 41*b* are sequentially disposed toward the downstream side.

In addition, the UV irradiation operations are performed by the provisional curing irradiating units 41*a* and 41*b* so that ink droplets discharged from the upstream side head 31*a* and landed on the medium S are provisionally cured by the light irradiated by the first provisional curing irradiating unit 41*a* and ink droplets discharged from the downstream side head 31*b* onto the medium S are provisionally cured by the light irradiated by the second provisional curing irradiating unit 41*b*. That is, in this embodiment, the provisional curing is performed, when UV ink is discharged from the heads 31*a* and 31*b* during transporting of the medium S and UV ink droplets are landed on the medium S, by irradiating the LTV ink droplets with low energy UV. In addition, with regard to the light source for the provisional curing irradiating units 41*a* and 41*b*, the same number of LEDs as that of the nozzles N included in the nozzle rows 33K, 33C, 33M, 33Y, and 33CL are disposed at the same pitch and at substantially the same positions as those of the nozzles along the line direction.

On the other hand, the main curing irradiating unit 42 is provided further on the downstream side in the transport direction with respect to the downstream side head 31*b* to extend in the line direction. The LTV irradiation range thereof is longer than the width of the medium S to be printed. In addition, the main curing irradiating unit 42 irradiates the medium S with UV when the medium S moves in the transport direction. Accordingly, the UV ink droplets that are provisionally cured on the medium S are fully cured.

Dot Omission Inspection Method

In the printer 1*a* having the above-described configuration as the example of the invention, a method of performing an optical dot omission inspection is exemplified. The controller 60 controls the units 10, 20, 30, and 40 and switches between a normal print mode in which the printer 1*a* forms an arbitrary image and an inspection print mode in which predetermined images (inspection images) such as test patterns are printed in a predetermined order to perform the dot omission inspection. Hereinafter, the orders of formation of the ink dots in the two print modes will be described as an example of the invention.

Normal Print Mode

Figure 4A:
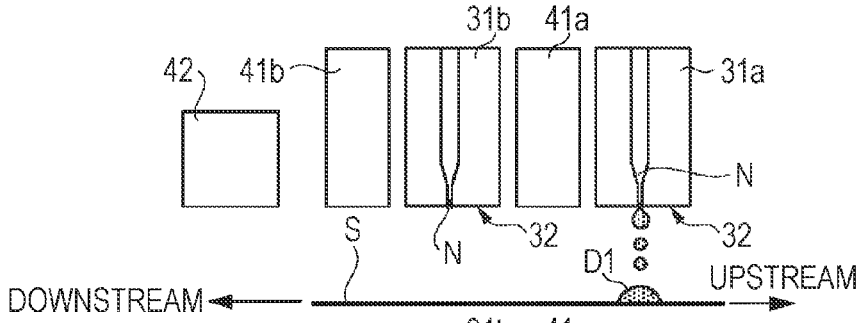
FIGS. 4A to 4E are diagrams schematically illustrating operations of the printer according to the first embodiment during a normal print mode.
Figure 4B:
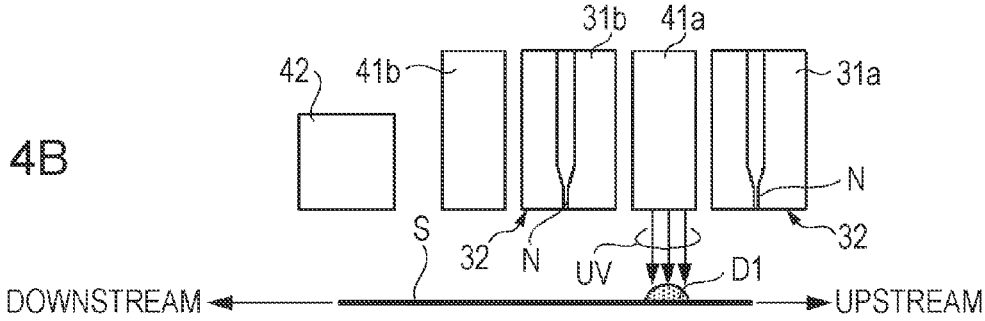
Figure 4C:
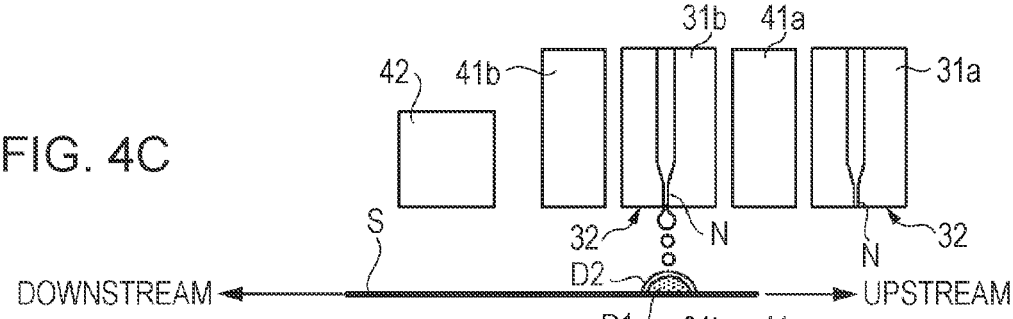
Figure 4D:
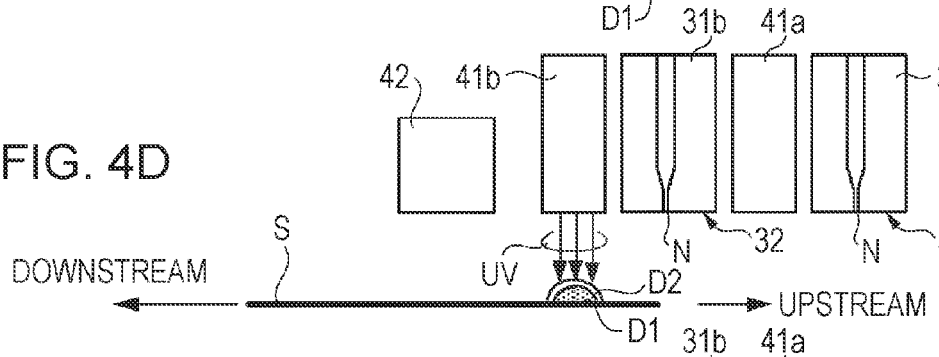
Figure 4E:
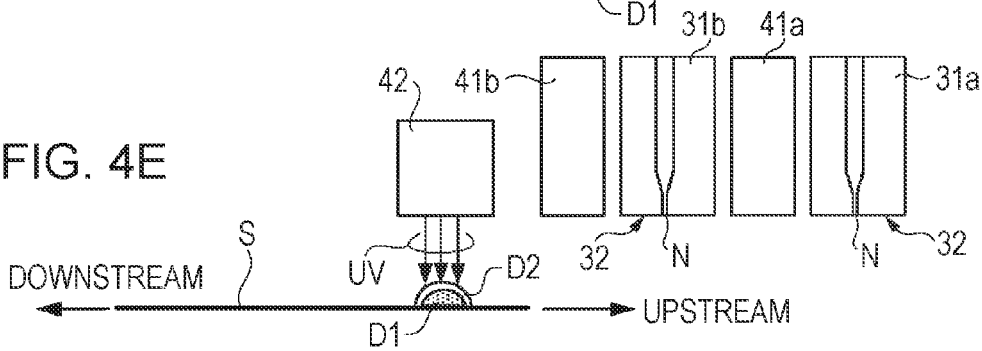

In the normal print mode, for example, operations for printing an arbitrary image such as a document or a still image displayed on a personal computer are performed. An example of the operations of the printing apparatus performed in the normal print mode is illustrated in FIGS. 4A to 4E. Here, the medium S is transported from the upstream side to the downstream side. First, a liquid droplet D1 of ink of a certain color is discharged from the upstream side head 31*a* onto the medium S being transported such that the liquid droplet D1 is landed on the medium S (FIG. 4A). In addition, the liquid droplet D1 of the ink is provisionally cured by the first provisional curing irradiating unit 41*a* (FIG. 4B). Next, a liquid droplet D2 of the clear ink is discharged from the downstream side head 31*b*, and the liquid droplet D2 of the clear ink is landed on the liquid droplet D1 of the ink of the certain color which is provisionally cured in advance (FIG. 4C). In addition, the liquid droplet D2 of the clear ink is provisionally cured by the second provisional curing irradiating unit 41*b* (FIG. 4D). Accordingly, the liquid droplet D1 of the color ink in the provisionally cured state is coated with the liquid droplet D2 of the clear ink which is provisionally cured. In addition, the liquid droplet D1 of the color ink and the liquid droplet D2 of the clear ink which are provisionally cured are irradiated with UV by the main curing irradiating unit 42 to fix the liquid droplets D1 and D2 as a dot of the color ink coated with the clear ink on the medium S (FIG. 4E).

Inspection Print Mode

In the inspection print mode, operations for printing an inspection image dedicated to inspect for a dot omission are performed. As the inspection image, an image formed as a regular pattern in which dots of colors are arranged in line or in a matrix form so as to represent the position of each dot as relative coordinates may be considered. That is, when a correspondence relationship between coordinates and dots on the surface of the medium S is determined in advance, existence of a dot omission can be detected on the basis of whether or not a dot of a predetermined color exists at a predetermined coordinate position when the inspection image is read by an optical instrument such as a scanner.

FIGS. 5A to 5E schematically illustrate the operations performed in the inspection print mode. In the figures, a principle of detecting a dot omission of the clear ink is shown. With regard to other color inks, a dot is formed on the medium S in the print order applied by the normal print mode illustrated in FIGS. 4A to 4E. Of course, in the inspection print mode, a dot of the other color inks is not necessarily coated with the clear ink. That is, the operations of FIGS. 4C and 4D in the order may be omitted.

Figure 5A:
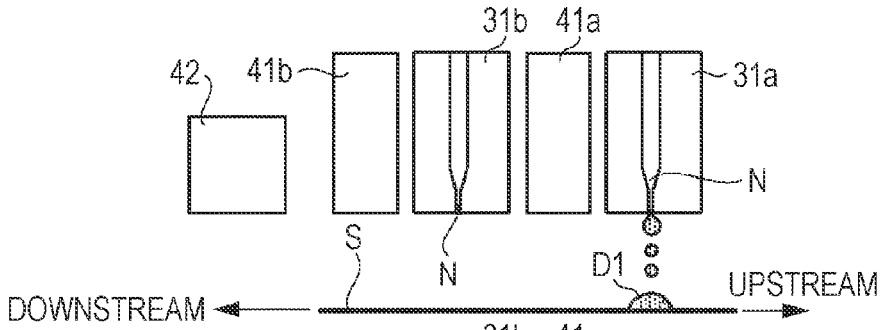
FIGS. 5A to 5E are diagrams schematically illustrating operations of the printer according to the first embodiment during an inspection print mode.
Figure 5B:
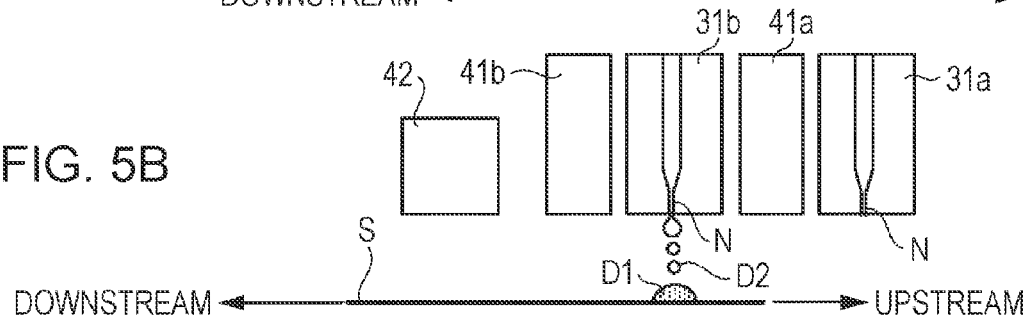
Figure 5C:
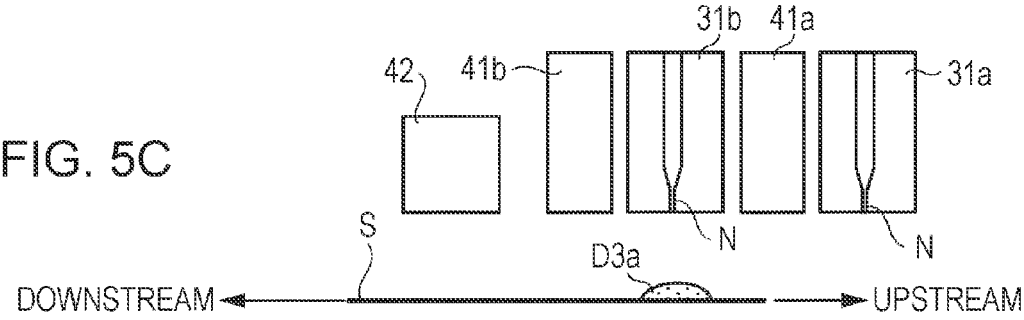
Figure 5D:
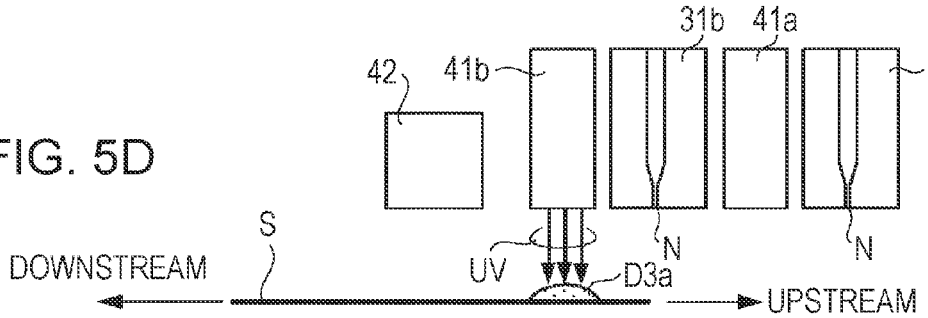
Figure 5E:
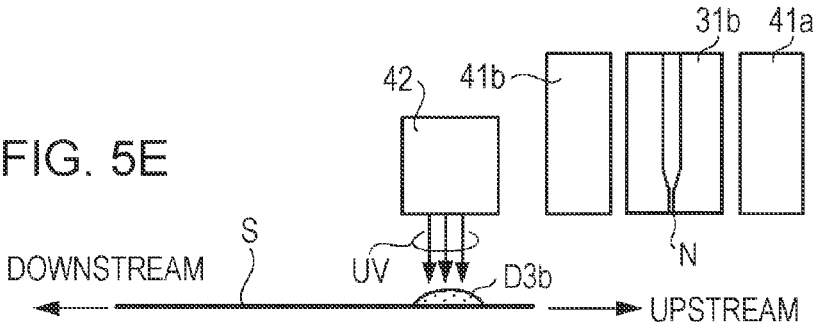

In order to print the inspection image, first, a liquid droplet D1 of ink of a certain color is discharged to be landed on the medium S (FIG. 5A). Then, the liquid droplet D1 of the ink is not subjected to provisional curing, a liquid droplet D2 of the clear ink is discharged, the liquid droplet D2 of the clear ink is landed on the liquid droplet D1 of the ink of the certain color which has already landed on the medium S (FIG. 5B). Accordingly, a liquid droplet D3*a* which is in a mixed state of the color ink landed in advance and the clear ink is formed on the medium S (FIG. 5C). The provisional curing is performed on the mixed liquid droplet D3*a* (FIG. 5D), and lastly, UV is irradiated by the main curing irradiating unit to cure the liquid droplet D3*a* in the mixed state thereby forming a dot D3*b* (mixed dot) formed by mixing the clear ink with the ink of the predetermined color is formed on the medium S (FIG. 5E).

In this example, the clear ink D2 is landed on the liquid droplet D1 of the color ink which has already landed on the medium S. However, on the contrary, the clear ink D2 may be landed on the medium S to cause the ink droplet D1 with the predetermined color to be landed at the position of the liquid droplet D2 of the clear ink. In addition, the provisional curing may not be performed on the liquid droplet D3*a* in the mixed state. That is, the operation illustrated in FIG. 5D may be omitted.

In addition, when the provisional curing is performed, it is possible to reliably prevent the liquid droplet D3*a* in the mixed state from flowing until the main curing is performed, and when the provisional curing is not performed, it is possible to save the power or time needed to perform the provisional curing. That is, whether or not to perform the provisional curing on the liquid droplet D3*a* in the mixed state may be determined depending on requirements for the dot omission inspection such as whether or not a precise inspection image is needed or whether or not the time or cost required for the inspection has to be reduced.

Dot Omission Inspection

The inspection image printed in the above-described inspection print mode is read by an optical instrument such as a scanner. Whether or not a color dot to be formed at a certain position exists is detected by analyzing the read image data to determine whether or not a liquid droplet is accurately landed. As the inspection image, a regular pattern in which dots of colors are arranged in line or in a matrix form so as to represent the position of each dot as relative coordinates may be considered. That is, when a correspondence relationship between coordinates and dots on the sheet surface is determined in advance, existence of a dot omission can be detected on the basis of whether or not a dot of a predetermined color exists at a predetermined coordinate position in the inspection image read by the optical instrument such as the scanner.

In addition, in the mixed dot D3*b* formed by fully curing the liquid droplet D3*a* which is a mixture of the liquid droplet D2 of the clear ink and the ink droplet D1 of the predetermined color, the density of the color ink mixed with the clear ink is reduced, so that the dot omission of the clear ink can be detected on the basis of whether or not the density is reduced. Otherwise, since the mixed dot D3 is formed by landing the liquid droplet D1 of the clear ink and the ink droplet of the predetermined color to be overlapped with each other at the same position without being subjected to provisional curing, an area occupied by the dot is greater than a dot formed of ink of a single color. Therefore, existence of a dot omission of clear ink can be determined by detecting the size of the area.

In addition, in recent ink jet printers, very fine dots are formed, and ink of a larger number of colors is used to enrich color expression. For example, ink of a light color such as a light yellow is provided. When ink based on such a light color is formed as a dot on a general white medium, an expensive scanner having high resolution and high sensitivity is needed, so that there is a problem in that the inspection cost is increased. In consideration of this problem, when an ink droplet with a different color is landed at the same position without being subjected to provisional curing, a mixed color which can be easily detected is formed or an area occupied by the dot is increased. Accordingly, the dot omission can be easily optically detected even when using a cheap scanner having low resolution and low sensitivity, thereby suppressing an increase in the inspection cost.

In this example, the printed inspection image is read by the additional scanner to inspect for the dot omission. However, instead of the external scanner, an imaging device such as a CCD having a large number of pixels may be embedded into the printer 1*a*. In addition, individual ink droplets D1*a* landed on the medium S or dots D2 after being subjected to main curing may be individually detected in conjunction with the printing operation. In the imaging device, for example, each pixel or a predetermined number of the pixels of the imaging device may correspond to a single nozzle N, and simultaneously, the imaging device may be disposed in line on the downstream side of the main curing irradiating unit 42. In addition, existence of the dot D2 may be detected until the medium S is discharged after the ink droplet D1*a* is fully cured. Otherwise, the imaging device may be provided between the second provisional curing irradiating unit 41*b* and the main curing irradiating unit 42.

Of course, the existence of the dot omission may be detected with the naked eye. Either way, the dot omission inspection method in this example is characterized by the order of forming the inspection image provided for inspecting for a dot omission in the printing apparatus having the provisional curing mechanism.

Inspection Image

As described above, in the inspection print mode, the mixed dot D3*b* for inspecting the clear ink is in a mixed state of the color ink and the clear ink at the landing position of the liquid droplet D3*a* to be formed as the mixed dot D3*b*. Accordingly, the mixed liquid droplet D3*a* is as in a state where a liquid droplet having a greater volume than a dot with a single color is landed once. In addition, in a case where the provisional curing s not performed on the liquid droplet in the mixed state, there is a higher possibility that the liquid droplet may flow. Accordingly, the size of the mixed dot D3*b* is greater than the dot to be inspected using a single color of color ink. Therefore, there is a possibility that in the inspection image, the mixed dot D3*b* and a dot adjacent thereto may overlap with each other and it may become difficult to individually detect the dots resulting in degradation in the reliability of the dot omission inspection. Therefore, in the inspection print mode, an inspection image in which an interval between the mixed dot D3*b* and the dot adjacent thereto is greater than an interval between other dots may be printed.

In addition, in a case where the inspection image is printed by the printer 1*a*, if the color ink and the clear ink can be landed at the same position, the mixed dot may be formed using only the upstream side head 31*a* or the downstream side head 31*b*.

Other Examples

In the dot omission inspection method in this example, in order to detect a dot omission of the clear ink, provisional curing is not performed, and a liquid droplet of the clear ink and a liquid droplet of ink of a predetermined color are landed at the same position. However, a case is assumed where a nozzle of the ink of the predetermined color clogs.

In this case, with regard to the ink with the predetermined color itself, since the liquid droplet of the color is not landed on the medium, the dot omission can be checked. However, although the liquid droplet of the clear ink is landed on the medium, with regard to the liquid droplet of the clear ink that is fixed on the medium while the liquid droplet remains transparent, it is difficult to check whether or not the dot omission actually occurs.

Therefore, a color to be mixed with the clear ink may be changed to form a plurality of kinds of mixed dot, or ink droplets with a plurality of different colors may be mixed with a liquid droplet of the single clear ink to form mixed dots.

In the case where the plurality of kinds of mixed dot is to be formed, if a dot omission of the clear ink occurs, a dot to be formed as a mixed dot is formed as a dot only with mixed color ink. If a dot omission of a particular mixed color ink occurs, a mixed dot of ink of different colors mixed is normally formed. If the mixed dot with other ink is not normally formed, a dot omission of the clear ink has occurred.

On the other hand, in the case where ink of a plurality of different colors is included in a single mixed dot, the color shown when the mixed dot is normally formed is different from the color shown when a dot omission of ink of several colors or the clear ink occurs. Therefore, by detecting the difference, whether the dot omission occurs in the ink of the particular color, in the clear ink, or in both may be determined.

In this example, the inspection image in which the dot with the clear ink is included is formed. However, it is natural that the dot omission inspection method in this example may be applied to a case where an inspection image in which a dot with white ink is included is formed on a white medium or a case where an inspection image in which a dot with ink having a certain color is included is formed on a medium having a color similar to the certain color.

Second Embodiment

The printer 1*a* according to the first embodiment is a line printer; however, a serial printer may also be employed. Specifically, instead of the configuration in which the head is disposed in the line direction over the width of the medium, a configuration in which the head moves in a direction intersecting the transport direction may be employed. In addition, the printer having this configuration is exemplified as a second embodiment, and hereinafter, a dot omission inspection method used in the printer according to the second embodiment will be described.

Figure 6:
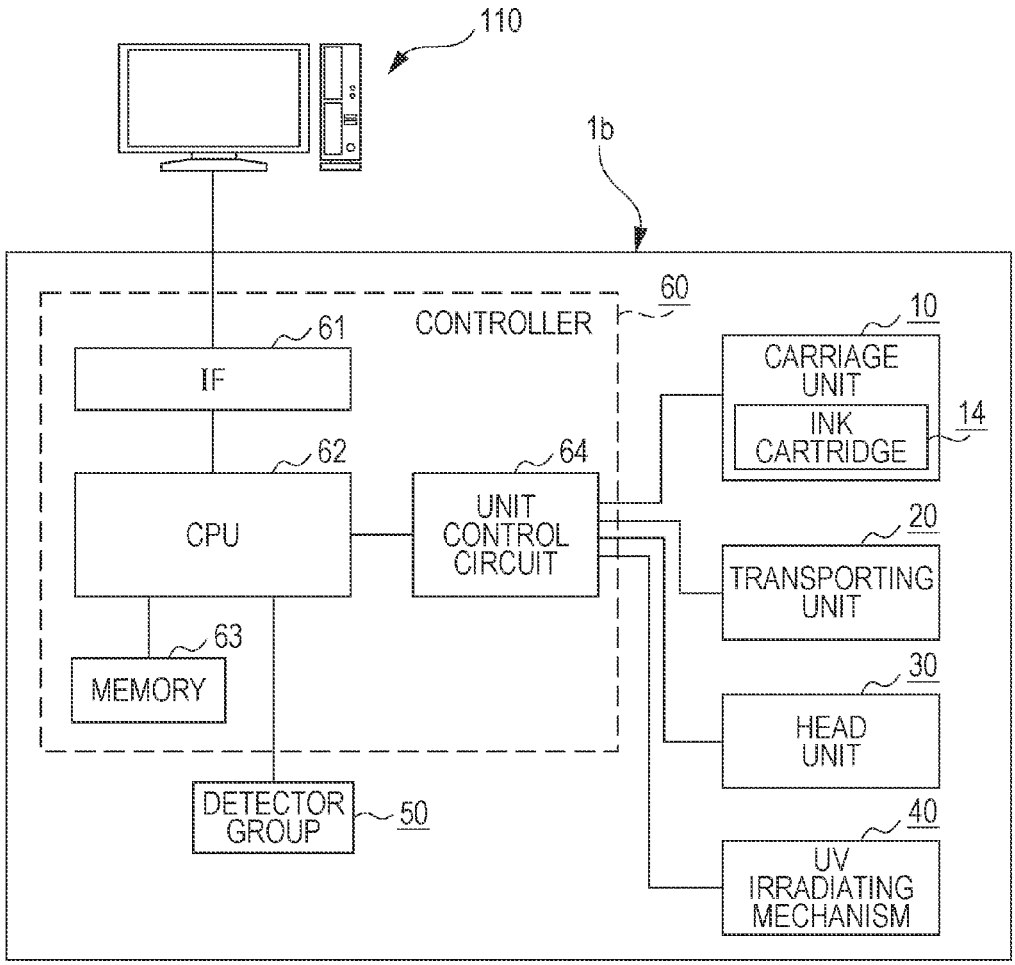
FIG. 6 is a block diagram illustrating the entire configuration of a printer according to a second embodiment of the invention.
Figure 7A:
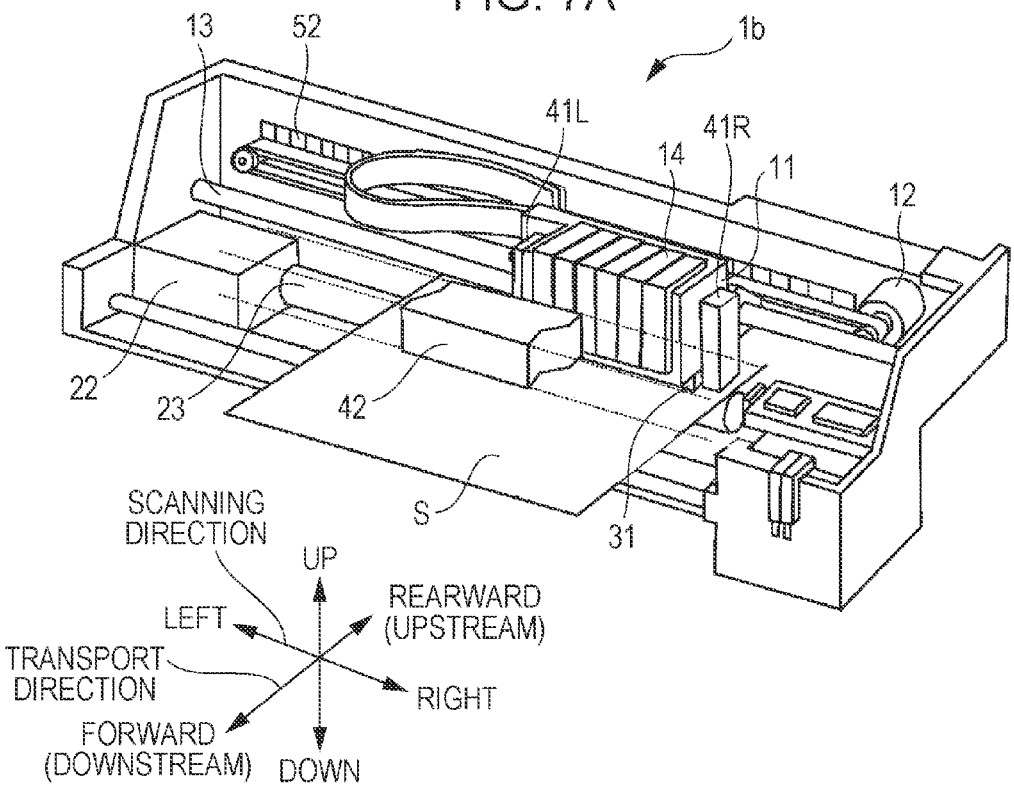
FIG. 7A is a partially cutaway perspective view of the entire configuration of the printer according to the second embodiment.
Figure 7B:
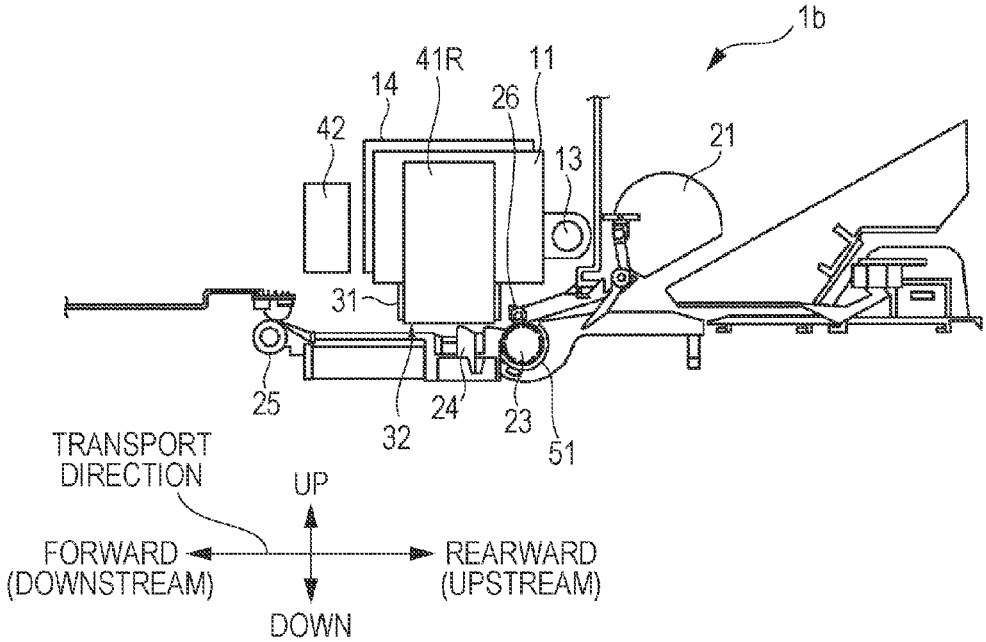
FIG. 7B is a transverse cross-sectional view of the entire configuration of the printer.

FIG. 6 is a function block diagram of a serial printer 1*b* (hereinafter, referred to as a printer 1*b*), and FIGS. 7A and 7B schematically illustrate the entire configuration of the printer 1*b*. FIG. 7A is a cutaway perspective view of the printer 1*b*, and FIG. 7B is a transverse cross-sectional view of the printer 1*b*. The printer 1*b* illustrated includes, as in the first embodiment, the transporting unit 20, the head unit 30, the UV irradiating mechanism 40, the detector group 50, and the controller 60, and also includes a carriage unit 10.

The carriage unit 10 moves the head 31 in the direction perpendicular to the transport direction (hereinafter, referred to as a scanning direction) and includes a carriage 11 and a carriage motor 12. The carriage 11 is guided by a carriage guide shaft 13 to reciprocate in the scanning direction and is driven by the carriage motor 12. In addition, ink of a plurality of different colors for performing multi-color printing and clear ink are charged in individual ink cartridges 14. In addition, the ink cartridges 14 corresponding to the ink of the colors and the clear ink are detachably mounted to the carriage 11. Moreover, in the detector group 50, a linear encoder 51 for detecting a position of the carriage 11 in the movement direction is included.

Figure 8:
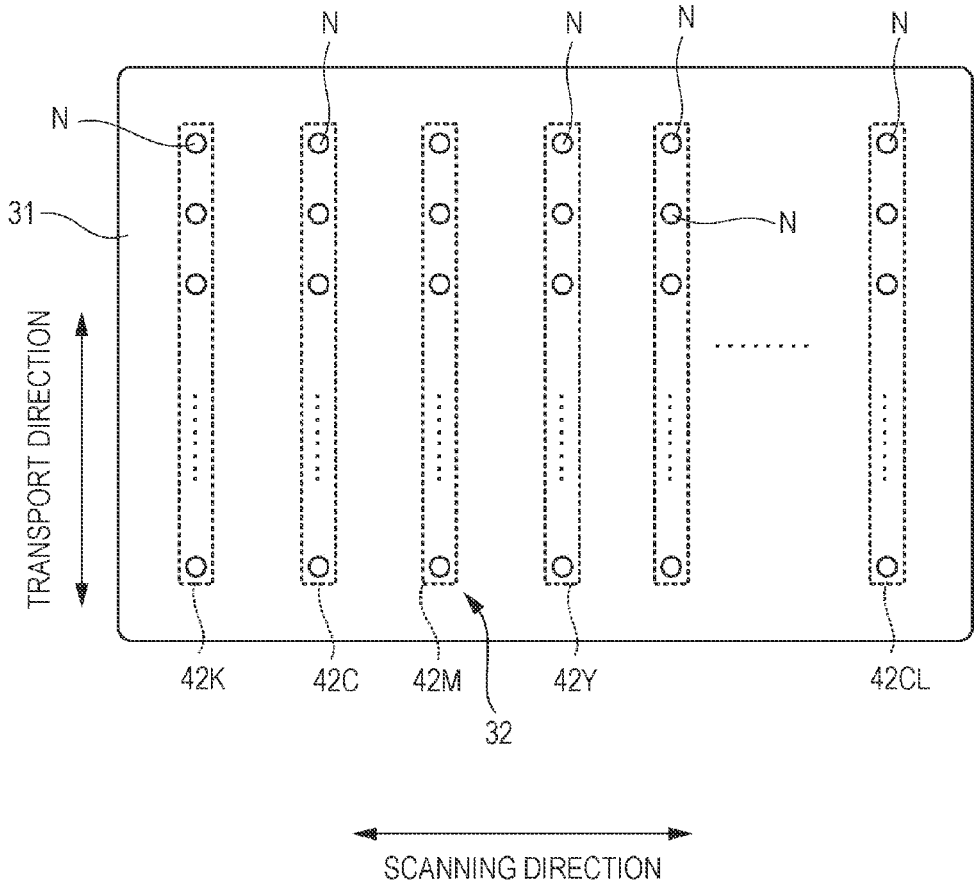
FIG. 8 is an explanatory view illustrating an array of nozzles included in the printer according to the second embodiment.

FIG. 8 illustrates an array of nozzles N in the printer 1*b* according to the second example. In the corresponding embodiment, a plurality of the nozzles N are lined and opened in the lower surface 32 of the head 31 at predetermined intervals in the transport direction, and nozzle rows 33K, 33C, 33M, 33Y, and 33CL are lined at predetermined intervals along the scanning direction. In addition, the head 31 having the configuration is integrated with the carriage 11 to move in the scanning direction and intermittently discharges ink droplets during the movement thereby forming a dot line (raster line) along the scanning direction on the medium S.

UV Irradiating Mechanism in Second Example

The printer 1*b* according to the second embodiment also includes two provisional curing irradiating units 41L and 41R and the main curing irradiating unit 42; however, the two provisional curing irradiating units 41L and 41R are respectively mounted on left and right sides of the carriage 31. In addition, UV light sources are provided on the lower surfaces of the provisional curing irradiating units 41L and 41R, and the provisional curing irradiating units 41L and 41R are moved along with the carriage 11 and irradiate the medium S with UV during the movement.

With regard to the LTV irradiating operation of the provisional curing irradiating units 41L and 41R, for example, UV is irradiated by the provisional curing irradiating unit 41R on the right when the carriage 11 is moved to the left, and UV is irradiated by the provisional curing irradiating unit 41L on the left when the carriage 11 is moved to the right. That is, in the second embodiment, "provisional curing" is performed by irradiating UV ink droplets with low energy UV when UV ink is discharged from the head 31 during the movement of the carriage 11 and the UV ink droplets are landed on the medium S. In addition, the light sources of the provisional curing irradiating units 41L and 41R have a configuration in which the same number of LEDs as the nozzles N included in the nozzle rows 33K, 33C, 33M, 33Y, and 33CL are arranged in lines along the transport direction such that the individual nozzles and the individual LEDs are arranged at the same pitches in the transport direction, and at the same time, the arrangement positions thereof are substantially aligned with each other.

Printing Operations in Second Example

Figure 9A:
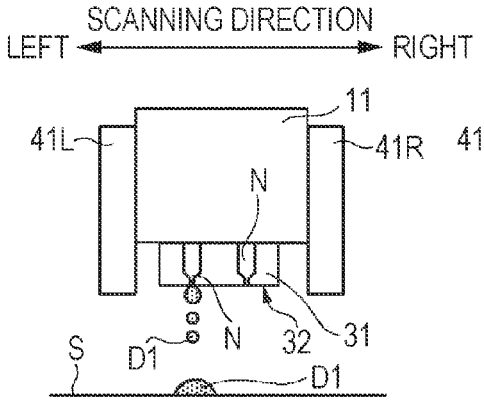
FIGS. 9A to 9E are diagrams schematically illustrating operations of the printer according to the second embodiment during the normal print mode.
Figure 9D:
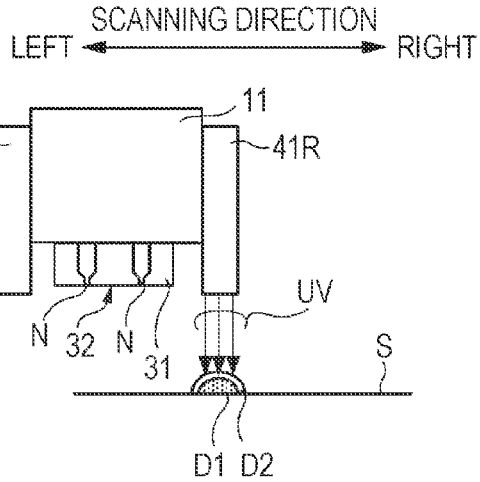
Figure 9B:
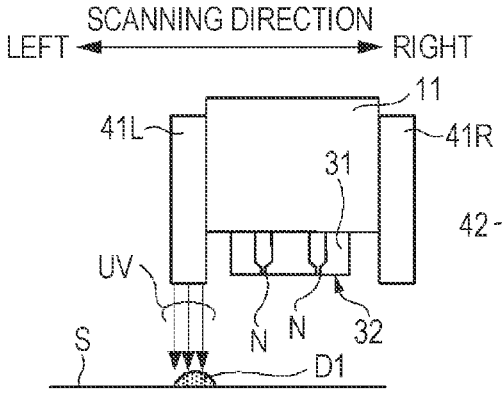
Figure 9E:
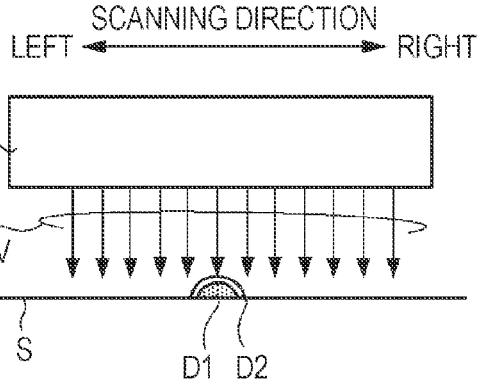
Figure 9C:
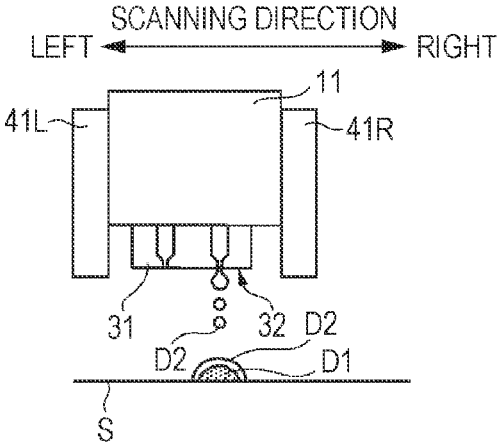

FIGS. 9A to 9E and FIGS. 10A to 10E schematically illustrate printing operations performed in the normal print mode by the printer 1*b* in the second example and printing operations performed in the inspection print mode, respectively. In the normal print mode, as illustrated in FIGS. 9A to 9E, first, while the head 31 is moved to either of the left and the right in the scanning direction, a liquid droplet D1 of ink of a certain color is discharged from the nozzle N to be landed on the medium S (FIG. 9A). Here, the discharge is made during the movement to the right. In addition, as the head 31 is moved to the further right, the liquid droplet D1 of the ink landed on the medium S is provisionally cured by the provisional curing irradiating unit 41L on the left (FIG. 9B). Next, while the head 31 is moved to the left, a liquid droplet D2 of the clear ink is discharged to be landed on the liquid droplet D1 of the color ink provisionally cured in advance (FIG. 9C). In addition, the head 31 is moved to the further left, and the liquid droplet D2 of the clear ink is provisionally cured by the provisional curing irradiating unit 41R on the right (FIG. 9D). Accordingly, the liquid droplet D1 of the color ink in the provisionally cured state is coated with the liquid droplet D2 of the clear ink provisionally cured. In addition, the medium S is transported in the downstream direction (in the figure, forward with respect to the sheet surface) so that the liquid droplet D1 of the color ink and the liquid droplet D2 of the clear ink which are provisionally cured are irradiated with UV by the main curing irradiating unit 42 (FIG. 9E), and the liquid droplets D1 and D2 are fixed on the medium S as a dot of the color ink coated with the clear ink.

Figure 10A:
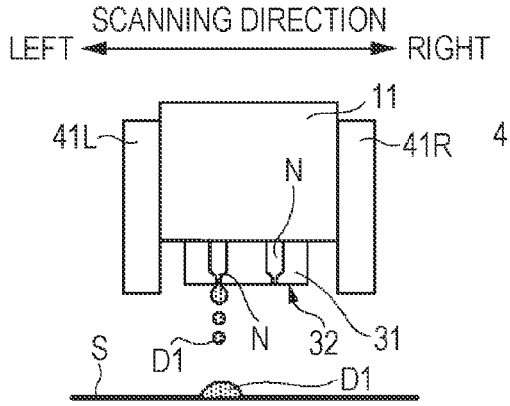
FIGS. 10A to 10E are diagrams schematically illustrating operations of the printer according to the second embodiment during the inspection print mode.
Figure 10D:
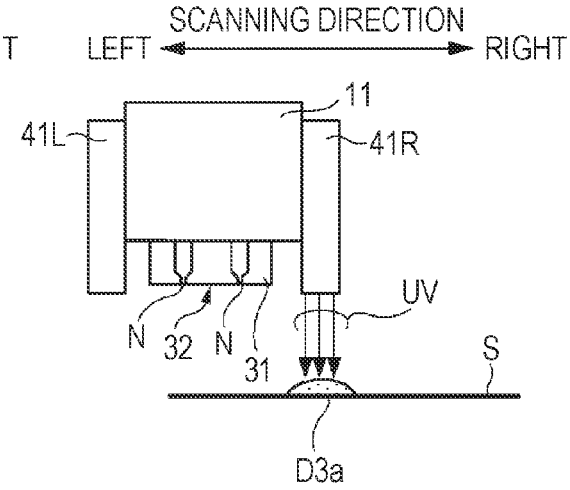
Figure 10B:
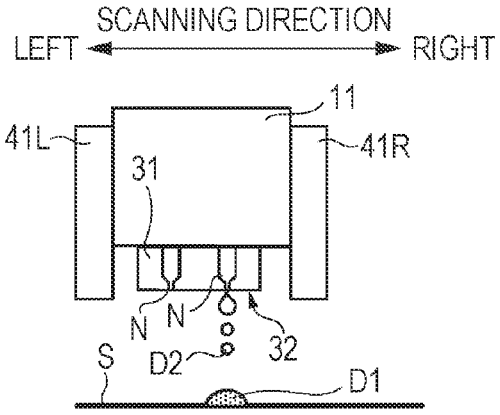
Figure 10E:
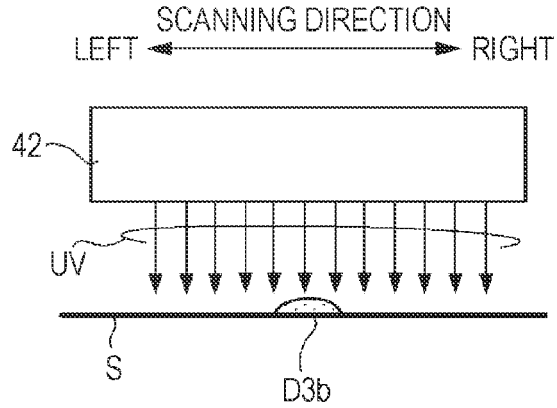
Figure 10C:
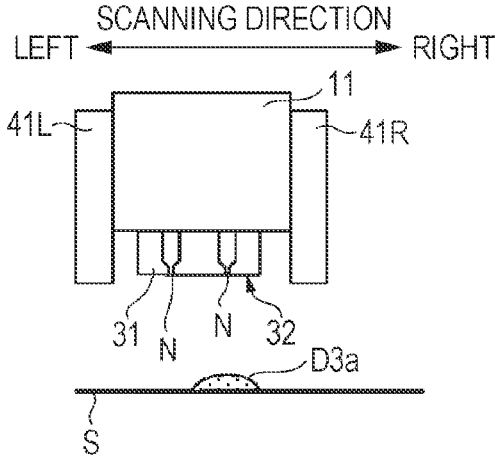

On the other hand, in the inspection print mode, first, while the head 31 is moved to either of the left or the right in the scanning direction, a liquid droplet D1 of ink of a certain color is discharged to be landed on the medium S (FIG. 10A). Here, the liquid droplet D1 of the ink of the certain color is discharged during the movement to the right. In addition, the liquid droplet D1 of the ink is not subjected to provisional curing, and a liquid droplet D2 of the clear ink is discharged subsequently to the ink of the certain color (FIG. 10B) to land the liquid droplet D2 of the clear ink on the liquid droplet D1 of the ink of the certain color landed on the medium S in advance. Accordingly, a liquid droplet D3*a* in a mixed state of the color ink landed in advance and the clear ink is formed on the medium S (FIG. 10C). With regard to the mixed liquid droplet D3*a*, as needed, the liquid droplet D3*a* in the mixed state is provisionally cured by the provisional curing irradiating unit 41L or 41R (FIG. 10D). Last, the mixed liquid droplet D3*a* is irradiated with LTV by the main curing irradiating unit 42 to cure the liquid droplet D3*a* in the mixed state, thereby forming a dot (mixed dot) D3*b* as a mixture of the clear ink and the ink of the predetermined color (FIG. 10E). Moreover, when the dot omission inspection is performed using the inspection image printed by the printer 1*b* according to the second embodiment, the dot omission inspection as in the first embodiment is used.

Other Embodiments of Printing Apparatus

In the printer 1*a* according to the first embodiment, the two heads 31*a* and 31*b* have the same array of nozzles N. However, for example, only nozzles for color inks may be provided in the upstream side head 31*a*, and only nozzles for clear ink may be provided in the downstream side head 31*b*.

In the embodiments, as the printers 1*a* and 1*b*, ink jet printers using a piezo method of applying a voltage to a drive element (piezo element) to expand and contract ink chambers thereby ejecting fluid are exemplified. However, a liquid discharge method is not limited thereto, and a thermal method of generating bubbles in nozzles using heat-generating elements to eject liquid due to the bubbles may be employed.

In addition, a medium to be printed by the printing apparatus is not limited to paper, and any type of medium including fabric, the label surface of an optical disc (such as a CD-R), and a substrate may be employed as long as ink can be printed thereon. Of course, the medium may be continuously transported like a roll paper or individually transported like a single cut sheet.

The invention can be applied to printing apparatuses for forming an image by discharging a plurality of types of ink to cause liquid droplets of ink to be landed on a medium, such as ink jet printers capable of multi-color printing.

What is claimed is:

1. A dot omission inspection method of inspecting for the existence of an omission of a dot, used in a printing apparatus which discharges a first photo-curable ink and a second photo-curable ink from respective nozzles to be landed on a medium as liquid droplets and irradiates the landed liquid droplets with light to be cured so as to form an image constituted by fine dots on the medium, wherein the printing apparatus selectively performs, as a process of forming the image, a normal print process of forming an arbitrary image and an inspection print process of forming an inspection image as a detection object for a dot omission, wherein the normal print process includes:

performing liquid droplet discharge of causing the liquid droplet of the first or second photo-curable ink to be landed on the medium;

performing provisional curing of irradiating the liquid droplet landed on the medium using light from a first light source to provisionally cure the liquid droplet so as to suppress flowing of the liquid droplet; and performing main curing of irradiating the provisionally cured liquid droplet using light from a second light source to cure the provisionally cured liquid droplet so as to be fixed on the medium, and wherein, in the inspection print process, the provisional curing is not performed on the liquid droplet of the first ink landed on the medium by the liquid droplet discharge, and the liquid droplet of the second ink is landed by the liquid droplet discharge at the same position as the liquid droplet of the first ink which is not provisionally cured so as to mix the first ink and the second ink with each other.

2. The dot omission inspection method according to claim 1, wherein, in the inspection print process, the liquid droplet of the first ink and the liquid droplet of the second ink which are landed at the same position and are in a mixed state are subjected to provisional curing.

3. The dot omission inspection method according to claim 1, wherein one of the first and second inks is a color ink and the other is a transparent ink.

4. The dot omission inspection method according to claim 1, wherein one of the first and second inks is a color ink and the other is a white ink.

5. The dot omission inspection method according to claim 1, wherein one of the first and second inks is an ink of a color different from the color of the medium, and the other is an ink of a color similar to the color of the medium.

6. The dot omission inspection method according to claim 3, wherein one of the first and second inks has a plurality of kinds with different colors, and in the inspection print process, a liquid droplet of the one ink of a plurality of different colors and a liquid droplet of the other ink are landed at the same position on the medium.

7. The dot omission inspection method according to claim 3, wherein one of the first and second inks has a plurality of kinds with different colors, and in the inspection print process, a liquid droplet formed by mixing the liquid droplet of the other ink with an ink of a certain color of the one ink, and a liquid droplet formed by mixing the liquid droplet of the other ink with an ink of a different color of the one ink are individually formed.

8. A printing apparatus for forming an image by causing a liquid droplet to be landed on a medium, comprising:

a plurality of nozzles for discharging a first ink and a second ink which are cured when irradiated with light as liquid droplets;

a first light irradiating unit;

a second light irradiating unit; and a control unit, wherein the first light irradiating unit irradiates the liquid droplets landed on the medium with light to provisionally cure the liquid droplets to prevent the liquid droplets from flowing, wherein the second light irradiating unit irradiates the liquid droplets landed on the medium with light to cure the liquid droplets so as to be fixed on the medium, wherein the control unit selectively performs a normal print process of forming an arbitrary image and an inspection print process of forming an inspection image as a detection object for a dot omission, wherein the normal print process includes:

performing liquid droplet discharge of causing the liquid droplet of the first or second photo-curable ink to be landed on the medium;

performing provisional curing of irradiating the liquid droplet landed on the medium using light from a first light source to provisionally cure the liquid droplet so as to suppress flowing of the liquid droplet; and performing main curing of irradiating the provisionally cured liquid droplet using light from a second light source to cure the provisionally cured liquid droplet so as to be fixed on the medium, and wherein, in the inspection print process, the provisional curing is not performed on the liquid droplet of the first ink landed on the medium by the liquid droplet discharge, and the liquid droplet of the second ink is landed by the liquid droplet discharge at the same position as the liquid droplet of the first ink which is not provisionally cured so as to mix the first ink and the second ink with each other.

* * * * *